US010519525B2

(12) United States Patent
Schulz et al.

(10) Patent No.: US 10,519,525 B2
(45) Date of Patent: Dec. 31, 2019

(54) HIGH STRENGTH MULTI-PHASE STEEL, AND METHOD FOR PRODUCING A STRIP FROM SAID STEEL

(71) Applicant: Salzgitter Flachstahl GmbH, Salzgitter (DE)

(72) Inventors: Thomas Schulz, Salzgitter (DE); Andreas Wedemeier, Braunschweig (DE); Michael Pohl, Braunschweig (DE); Hans-Joachim Kratz, Salzgitter (DE); Matthias Geler, Langelsheim (DE); Oliver Meyer, Braunschweig (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 652 days.

(21) Appl. No.: 14/386,602

(22) PCT Filed: Feb. 27, 2013

(86) PCT No.: PCT/DE2013/000125
§ 371 (c)(1),
(2) Date: Sep. 19, 2014

(87) PCT Pub. No.: WO2013/139319
PCT Pub. Date: Sep. 26, 2013

(65) Prior Publication Data

US 2015/0034215 A1 Feb. 5, 2015

(30) Foreign Application Priority Data

Mar. 20, 2012 (DE) ..... 10 2012 006 017

(51) Int. Cl.
*C21D 8/02* (2006.01)
*C21D 9/56* (2006.01)
(Continued)

(52) U.S. Cl.
CPC ..... *C21D 8/0247* (2013.01); *C21D 1/18* (2013.01); *C21D 1/26* (2013.01); *C21D 8/0205* (2013.01);
(Continued)

(58) Field of Classification Search
CPC ... C21D 1/26; C21D 1/28; C21D 1/30; C21D 1/32; C21D 9/46; C21D 9/48; C21D 9/52;
(Continued)

(56) References Cited

U.S. PATENT DOCUMENTS 4,285,741 A * 8/1981 Furukawa ..... C21D 8/0263 148/320
6,589,369 B2 * 7/2003 Yokoi ..... C21D 8/0226 148/320
(Continued)

FOREIGN PATENT DOCUMENTS

DE 102004053620 5/2006
EP 0796928 9/1997
(Continued)

OTHER PUBLICATIONS

"Glossary of Metallurgical and Metalworking Terms," Metals Handbook, ASM Handbooks Online, ASM International, 2002, pp. 1, 37, 210, 225, 226, 233, 257.*
(Continued)

*Primary Examiner* — Vanessa T. Luk
(74) *Attorney, Agent, or Firm* — Henry M. Feiereisen LLC

(57) ABSTRACT

A high-strength multi-phase steel having tensile strengths of no less than 580 MPa, preferably with a dual-phase structure for a cold-rolled or hot-rolled steel strip having improved forming properties, in particular for lightweight vehicle construction is disclosed, containing the following elements
(Continued)

(Legend ZT = intermediate temperature, RT = room temperature)

(contents in % by mass): C 0.075 to ≤0.105; Si 0.200 to ≤0.300; Mn 1.000 to ≤2.000; Cr 0.280 to ≤0.480; Al 0.10 to ≤0.060; P ≤0.020; Nb ≥0.005 to ≥0.025; N ≥0.0100; S ≥0.0050; the remainder iron, including conventional steel-accompanying elements not mentioned above.

14 Claims, 14 Drawing Sheets

(51) Int. Cl.

| | |
|---|---|
| ***C21D 9/46*** | (2006.01) |
| ***C21D 1/18*** | (2006.01) |
| ***C21D 1/26*** | (2006.01) |
| ***C22C 1/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/38*** | (2006.01) |
| ***C23C 2/02*** | (2006.01) |

(52) U.S. Cl.
CPC ..... *C21D 8/0226* (2013.01); *C21D 8/0284* (2013.01); *C21D 9/46* (2013.01); *C21D 9/56* (2013.01); *C22C 1/02* (2013.01); *C22C 38/001* (2013.01); *C22C 38/002* (2013.01); *C22C 38/02* (2013.01); *C22C 38/04* (2013.01); *C22C 38/06* (2013.01); *C22C 38/26* (2013.01); *C22C 38/38* (2013.01); *C23C 2/02* (2013.01)

(58) Field of Classification Search
CPC . C21D 9/525; C21D 9/54; C21D 9/56; C21D 9/561; C21D 9/562; C21D 9/563; C21D 9/564; C21D 9/565; C21D 9/567; C21D 9/573; C21D 9/5732; C21D 9/5735; C21D 9/5737; C21D 9/58; C21D 9/60; C21D 9/62; C21D 2211/005; C21D 2211/008; C21D 9/63; C21D 9/64; C21D 9/66; C21D 9/663; C21D 9/665; C21D 9/667; C21D 9/67; C21D 9/673; C21D 9/675; C21D 9/677; C21D 9/68; C21D 9/70
See application file for complete search history.

(56) References Cited

U.S. PATENT DOCUMENTS

| | | | | |
|---|---|---|---|---|
| 7,553,380 | B2 * | 6/2009 | Ikeda | C21D 1/185 148/320 |
| 2003/0155052 | A1 | 8/2003 | Kondo et al. | |
| 2004/0238080 | A1 * | 12/2004 | Vandeputte | C21D 8/0273 148/602 |
| 2008/0314481 | A1 | 12/2008 | Garcia et al. | |
| 2009/0173412 | A1 | 7/2009 | Schoettler et al. | |
| 2010/0000634 | A1 * | 1/2010 | Spehr | C21D 8/1222 148/537 |
| 2010/0037995 | A1 * | 2/2010 | Watanabe | C21D 1/26 148/645 |
| 2011/0008647 | A1 * | 1/2011 | Azuma | C21D 9/46 148/533 |
| 2011/0067788 | A1 * | 3/2011 | Swiatek | C21D 6/00 148/645 |
| 2012/0018028 | A1 | 1/2012 | Shimamura et al. | |
| 2012/0118439 | A1 * | 5/2012 | Ono | C21D 9/46 148/533 |
| 2014/0034196 | A1 | 6/2014 | Wedemeier et al. | |

FOREIGN PATENT DOCUMENTS

| | | | | |
|---|---|---|---|---|
| EP | 1113085 | | 7/2001 | |
| EP | 1201780 | | 5/2002 | |
| JP | WO 2010150919 | A1 * | 12/2010 | C21D 9/46 |
| WO | WO2012/100762 | | 8/2012 | |

OTHER PUBLICATIONS

International Search Report issued by the European Patent Office in International Application PCT/DE2013/000125 dated Mar. 20, 2012.

* cited by examiner

| Element (example) | C [weight %] | Si [weight %] | Mn [weight %] | Cr [weight %] | Al [weight %] | P [weight %] | Nb [weight %] | N [weight %] | S [weight %] | Ceq IIW |
|---|---|---|---|---|---|---|---|---|---|---|
| Standard grade | 0,131 | 0,125 | 1,266 | 0,632 | 0,038 | 0,030 | 0,0023 | 0,0050 | 0,0020 | 0,47 |
| Invention variant 1 | 0,084 | 0,255 | 1,793 | 0,334 | 0,042 | 0,013 | 0,0111 | 0,0049 | 0,0006 | 0,46 |
| Invention variant 2 | 0,085 | 0,256 | 1,638 | 0,380 | 0,048 | 0,015 | 0,0125 | 0,0049 | 0,0006 | 0,44 |
| Invention variant 3 | 0,090 | 0,250 | 1,490 | 0,331 | 0,041 | 0,014 | 0,0171 | 0,0051 | 0,0010 | 0,41 |

Figure 3

| Characteristic values transverse to the rolling direction (examples) | Sheet thickness [mm] | Re [MPa] | Rm [MPa] | A80 [%] | $n_{10\text{-}UE}$ [] |
|---|---|---|---|---|---|
| Standard grade | 1,472 | 369 | 621 | 21,86 | 0,145 |
| Invention variant 1 | 2,156 | 388 | 631 | 23,14 | 0,155 |
| Invention variant 2 | 1,377 | 367 | 608 | 23,96 | 0,165 |
| Invention variant 3 | 0,985 | 359 | 602 | 24,38 | 0,172 |

| Characteristic values transverse to the rolling direction (examples) | Sheet thickness [mm] | Re [MPa] | Rm [MPa] | A80 [%] | $n_{10\text{-}UE}$ [] |
|---|---|---|---|---|---|
| Standard grade | 1,472 | 381 | 631 | 22,81 | 0,146 |
| Invention variant 1 | 2,156 | 379 | 622 | 25,03 | 0,157 |
| Invention variant 2 | 1,377 | 361 | 603 | 25,68 | 0,167 |
| Invention variant 3 | 0,985 | 352 | 600 | 26,18 | 0,176 |

Figure 4a

| Characteristic values transverse to the rolling direction (regression calculation) | Sheet thickness [mm] | Re | Rm | A80 | $n_{10\text{-}UE}$ | Re/Rm |
|---|---|---|---|---|---|---|
| | | [MPa] | [MPa] | [%] | [_] | [%] |
| Invention variant 1 | 2,5 | 405 | 646 | 23,35 | 0,156 | 63 |
| Invention variant 2 | 1,5 | 384 | 639 | 24,15 | 0,168 | 60 |
| Invention variant 3 | 0,8 | 363 | 617 | 25,20 | 0,180 | 59 |

Figure 4b

| Characteristic values (examples) | Sheet thickness [mm] | Re [MPa] | Rm [MPa] | A80 [%] | n-Value [_] |
|---|---|---|---|---|---|
| Standard grade | 0,77 | 525 | 831 | 15,86 | 0,137 |
| Invention variant 1 (rolling reduction degree 70%) | 0,77 | 456 | 782 | 17,38 | 0,145 |

| Element (examples) | C [weight %] | Si [weight %] | Mn [weight %] | Cr [weight %] | Al [weight %] | P [weight %] | Nb [weight %] | N [weight %] | S [weight %] | Ceq IIW |
|---|---|---|---|---|---|---|---|---|---|---|
| Standard grade | 0,149 | 0,257 | 1,827 | 0,384 | 0,040 | 0,014 | 0,003 | 0,0050 | 0,0010 | 0,54 |
| Invention variant 1 | 0,084 | 0,255 | 1,793 | 0,334 | 0,042 | 0,013 | 0,011 | 0,0049 | 0,0006 | 0,46 |

Figure 4c

| Characteristic values (examples) | Sheet thickness [mm] | Re [MPa] | Rm [MPa] | A80 [%] | n-Value [_] |
|---|---|---|---|---|---|
| Invention variant 1 (rolling reduction degree 0%) | 2,5 | 348 | 584 | 24,31 | 0,159 |

Figure 4d

| Characteristic values (Longitudinally to the rolling direction) Invention variant 1 | Achievable steel grade According to EN 10346 | Sheet-Thickness [mm] | Re [MPa] | Rm [MPa] | A80 [%] | Ferrite [%] | Martensite [%] | Bainite [%] | Residual austenite [%] |
|---|---|---|---|---|---|---|---|---|---|
| 1. pickled hot strip | HDT580X | 4.44 | 330 | 636 | 22.05 | 75 | 25 | 0 | 5.9 |
| 2. cold re-rolled hot strip (skin passed) | HCT600X | 4.00 | 317 | 673 | 22.20 | 80 | 20 | 0 | 5.3 |
| 3. cold strip with minimal rolling reduction degrees (10%) | HCT600X | 4.00 | 317 | 673 | 22.20 | 80 | 20 | 0 | 5.3 |
| 4. cold strip with reduced rolling reduction degrees (32%) | HCT600X | 3.00 | 313 | 690 | 20.55 | 65 | 25 | 10 | 5.7 |
| 5.cold strip with reduced rolling reduction degrees (44%) | HCT600X | 2.50 | 319 | 714 | 20.25 | 70 | 25 | 5 | 5.2 |
| 6. cold strip with common rolling reduction degrees (55%) | HCT600X | 2.00 | 316 | 716 | 19.65 | 60 | 27 | 15 | 5.0 |
| 7. cold strip with common rolling reduction degrees (66%) | HCT600X | 1.50 | 324 | 736 | 16.95 | 20 | 30 | 50 | 6.5 |
| 8. cold strip with high rolling reduction degrees (77%) | HCT600X Potential for HCT780X) | 1.00 | 339 | 759 | 20.65 | 15 | 30 | 55 | 4.9 |
| 9. cold strip with high rolling reduction degrees (84%) | HCT600X Potential for HCT780X) | 0.70 | 336 | 750 | 19.45 | 10 | 30 | 60 | 4.3 |

Figure 8

(Legend ZT = intermediate temperature, RT = room temperature)

(Legend ST = hot dip bath temperature, ZT = intermediate temperature, RT = room temperature)

(Legend ST = hot dip bath temperature, ZT = intermediate temperature, RT = room temperature)

HIGH STRENGTH MULTI-PHASE STEEL, AND METHOD FOR PRODUCING A STRIP FROM SAID STEEL

CROSS-REFERENCES TO RELATED APPLICATIONS

This application is the U.S. National Stage of International Application No. PCT/DE2013/000125, filed Feb. 27, 2013, which designated the United States and has been published as International Publication No. WO 2013/139319 A1 and which claims the priority of German Patent Application, Serial No. 10 2012 006 017.3, filed Mar. 20, 2012, pursuant to 35 U.S.C. 119(a)-(d).

BACKGROUND OF THE INVENTION

The invention relates to a high strength multiphase steel.

The invention also relates to a method for producing a hot or cold rolled strip from such a steel according to patent claim 9.

The invention relates in particular to steels with tensile strengths in the range of from 580-900 MPa with low yield ultimate ratio of below 67% for producing components which have excellent formability and welding properties.

The hotly contested automobile market forces manufacturers to constantly seek solutions to lower the fleet consumption while at the same time maintaining a highest possible comfort and occupant protection. Hereby weight saving of all vehicle components plays an important role but also a best possible behavior of the individual components under conditions of high static or dynamic stress during use and also in the event of a crash. Pre material suppliers seek to account for this requirement by providing high-strength and ultra-high strength steels with thin sheet thickness to reduce the weight of the vehicle components while at the same time improving forming and component properties during manufacture and during use.

High-strength and ultra-high strength steels enable more lightweight vehicle components (for example passenger cars and trucks) which as a consequence leads to reduced fuel consumption. The reduced $CO_2$ proportion associated therewith leads to a reduction in pollution.

These steels therefore have to meet relatively high demands regarding their strength and ductility, energy absorption capacity and during processing, such as for example during pickling, the hot or cold forming, welding and/or surface treatment (for example metallically finished, organically coated, varnishing).

Newly developed steels thus must met the demands on the required weight reduction, the increasing material demands on yield strength, tensile strength and elongation at break at good formability, as well as demands on the component of high tenacity, border crack resistance, energy absorption and strength via the work hardening effect and the bake hardening effect, but also improved suitability for joining in the form of improved weldability.

Improved edge crack resistance means increased hole expansion and is known under synonymous terms such as high hole expansion (HHE) or low edge crack (LEC).

Improved weldability is achieved inter alia by a lowered carbon equivalent. For this stand synonymous terms such as low carbon equivalent (LCE) or under peritectical (UP).

In vehicle construction dual phase steels are therefore increasingly used, which consist of a ferritic basic structure in which a martensitic second phase and possibly a further phase with bainite and residual austenite is integrated. Bainite can be present in different forms.

The processing properties of the dual steel which determine the steel types such as a low yield ultimate ratio at very high tensile strength, a strong cold hardening and a good cold formability are well known.

Increasingly, multiphase steels are also used such as complex-phase steels, ferritic-bainitic steels, bainitic steels and also martensitic steels, which are characterized by different microstructure compositions as described in EN 10346.

Complex phase steels are steels which contain small proportions of martensite, residual austenite and/or perlite in a ferritic/bainitic basic structure wherein an extreme grain refinement is caused by a delayed re-crystallization or by precipitations of micro-alloy elements.

Ferritic bainitic steels are steels which contain bainite or strain hardened bainite in a matrix of ferrite and/or strain hardened ferrite. The hardening of the matrix is caused by a high dislocation density by grain refinement and the precipitation of micro alloy elements.

Bainitic steels are steels which are characterized by a very high yield strength and tensile strength at a sufficiently high expansion for cold forming processes. The chemical composition results in a good weldability. The microstructure typically consists of bainite. In some cases small proportions of other phases such as marteniste and ferrite can be contained.

Martensitic steels are steels, which as a result of thermo mechanical rolling contain small proportions of ferrite and/or bainite in a basic structure of martensite. The steel type is characterized by a very high yield strength and tensile strength at sufficiently high expansion for cold forming processes. Within the group of multi-phase steels the martenisititc steels have the highest tensile strength values.

These steels are used in structural components, chassis and crash-relevant components as well as flexibly cold rolled strips. This Tailor Rolled Blank lightweight construction technology (TRB®) enables a significant weight reduction as a result of the load adjusted selection of sheet thickness over the length of the component.

However, when strongly varying sheet thicknesses are involved, the alloys and continuous annealing systems known and available today impose certain limitations on the production of TRB®s with multiphase microstructure, for example with regard to heat treatment prior to the cold rolling. In regions of different sheet thickness, i.e., when varying degrees of rolling reduction are present, a homogenous multiphase microstructure cannot be established in cold rolled and hot rolled steel strips due to the temperature difference in the conventional process windows.

For economic reasons cold rolled steel strips are usually subjected to recrystallizing annealing in the continuous annealing process to generate well formable steel sheet. Depending on the alloy composition and the strip cross section, the process parameters such as throughput speed, annealing temperature and cooling rate, are adjusted corresponding to the mechanical-technological properties by way of the microstructure required therefore.

For establishing the dual-phase microstructure, the hot strip in typical thicknesses between 1.50 mm to 4.00 mm, or cold strip in typical thicknesses of 0.50 mm to 3.00 mm, is heated in the continuous annealing furnace to such a temperature that the required microstructure forms during the cooling. The same applies for configuring a steel with complex phase microstructure, martensitic, ferrite-bainitic and also purely bainitic microstructure.

In the continuous annealing system, a special heat treatment is applied in which relatively soft components such as ferrite or bainitic ferrite provide the steel with its low yield strength and hard components such as martensite or carbon-rich bainite provide it with its strength.

When high demands on corrosion protection require the surface of the hot or cold strip to be hot dip galvanized, the annealing is usually carried out in a continuous annealing furnace arranged upstream of the hot dip galvanizing bath.

In the continuous annealing of hot rolled or cold rolled steel strips with alloy concepts known for example from EP 1 113 085 A1, EP 1 201 780 A1 and EP 0 796 928 A1 for a multiphase steel involves the problem that with the there tested alloy compositions the demanded mechanical properties are satisfied but an only narrow process window is available for the annealing parameters in order to be able to ensure uniform mechanical properties over the strip length in the case of cross sectional steps without adjustment of the process parameters.

A further disadvantage of the steel known from EP 0 796 928 A1 is that the very high Al-contents of 0.4-2.5% adversely affects steel production via conventional band casting, due to micro segregation and casting powder inclusions.

In the case of widened process windows the required strip properties can also be achieved at same process parameters also in the case of greater cross sectional changes of the strips to be annealed.

Besides flexibly rolled strips, which have different thicknesses over their width, this applies in particular also to strips of different thicknesses and/or different widths, which have to be annealed subsequent to each other.

Especially in the case of different thicknesses in the transition region of one strip to another, a homogenous temperature distribution is difficult to achieve. In the case of alloy compositions with too narrow process windows this can lead to the fact that for example the thinner strip is either moved through the furnace too slowly, thereby lowering productivity, or that the thicker strip is moved through the furnace too fast and the required annealing temperature for achieving the desired microstructure is not reached. The result of this is more waste with the corresponding non-conformity costs.

The deciding process parameter is thus the adjustment of the speed in the continuous annealing because the phase transformation is temperature and time dependent. Thus, the less sensitive the steel is regarding the uniformity of the mechanical properties when temperature and time course change during the continuous annealing, the greater is the process window.

The problem of a too narrow process window is especially pronounced in the annealing treatment when stress-optimized components made of hot or cold strip are to be produced, which have sheet thicknesses that vary across the strip length and strip width (for example as a result of flexible rolling).

A method for producing a steel strip with different thickness across the strip length is for example described in DE 100 37 867 A1.

When using the known alloy concepts for the group of multiphase steels, the narrow process window makes it already difficult during the continuous annealing of strips with different thicknesses to establish uniform mechanical properties over the entire length of the strip.

In the case of flexibly rolled cold strip made of multiphase steels of known compositions, the too narrow process window either causes the regions with lower sheet thickness to have excessive strengths resulting from excessive martensite proportions due to the transformation processes during the cooling, or the regions with greater sheet thickness achieve insufficient strengths as a result of insufficient martensite proportions. Homogenous mechanical-technological properties across the strip length or width can practically not be achieved with the known alloy concepts in the continuous annealing.

The goal to achieve the resulting mechanical-technological properties in a narrow region across the strip width and strip length by the controlled adjustment of the volume proportions of the microstructure phases has highest priority and is therefore only possible through a widened process window. The known alloy concepts for multiphase steels are characterized by a too narrow process window and are therefore not suited for solving the present problem, in particular in the case of flexibly rolled strips. With the alloy concepts known to date only steels of a strength class with defined cross sectional regions (sheet thickness and strip width) can be produced, hence requiring different alloy concepts for different strength classes or cross sectional ranges.

The state of the art is to increase the strength by increasing the amount of carbon and/or silicone and/or manganese and via the microstructure adjustment and solid solution strengthening (solid solution hardening).

However, increasing the amounts of the aforementioned elements, increasingly worsens the material processing properties for example during welding, forming and hot dip coating.

On the other hand, there is also a trend in the steel production to reduce the carbon and/or manganese content in order to achieve a better cold processability and better performance properties.

For describing and quantifying the edge crack behavior, the hole expansion test according to ISO 11630 is used as one of multiple possible test methods. At corresponding optimized grades, the steel user expects higher values than in the standard material. However, increasingly the focus is also on welding suitability characterized by the carbon equivalent.

A low yield strength ratio (Re/Rm) is typical for a dual-phase steel and serves in particular for the formability in stretching and deep drawing processes. This provides the constructor with information regarding the distance between ensuing plastic deformation and failing of the material at quasi static load. Correspondingly lower yield strength ratios represent a greater safety margin for the component failure.

A higher yield strength ratio (Re/Rm) as it is typical for complex-phase steels is also characterized by a resistance against edge cracks. This can be attributed to the smaller differences in the strengths of the individual microstructure components, which has a positive effect on a homogenous deformation in the region of the cutting edge.

The analytical landscape for achieving multiphase steels with minimal strengths of 580 MPa has become more diverse and shows very broad alloy ranges regarding the strength-promoting elements carbon, silicone, manganese, phosphorous, aluminum and chromium and/or molybdenum as well as regarding the addition of micro-alloys such as titanium and vanadium and regarding the material characterizing properties.

The spectrum regarding dimensions is broad and lies in the thickness range of 0.50 to 4.00 mm. Predominantly strips up to about 1850 mm are used but also slit strip dimensions which are generated by longitudinally separating the strips. Sheets or plates are generated by transverse separation of the strips.

SUMMARY OF THE INVENTION

The invention is therefore based on the object to set forth a new alloy concept for a high strength multi-phase steel with a minimal tensile strength of 580 MPa longitudinally and transversely to the rolling direction, preferably with dual-phase microstructure and a yield strength ratio of less than 67% with which the process window for the continuous annealing of hot and cold rolled strips can be widened so that beside strips with different cross sections also steel strips with thicknesses that vary over the strip length or strip width and the correspondingly varying cold rolling reduction degrees can be generated with highest possible homogenous mechanical technological properties. In addition a method for producing a strip made of this steel is set forth.

According to the teaching of the invention this object is solved by a steel with the following contents in weight %:

C 0.075 to ≤0.105
Si 0.200 to ≤0.300
Mn 1.000 to ≤2.000
Cr 0.280 to ≤0.480
Al 0.010 to ≤0.060
P ≤0.020
Nb ≥0.005 to ≤0.025
N ≤0.0100
S ≤0.0050 remainder iron including usual steel accompanying elements not mentioned above.

The steel according to the invention has the advantage of a significantly widened process window compared to the known steels. This results in an increased process reliability during continuous annealing of cold and hot strip with dual-phase microstructure. Thus more homogenous mechanical-technological properties can be ensured in the strip for continuously annealed hot or cold strips also in the case of different cross sections and otherwise same process parameters.

This applies for the continuous annealing of subsequent strips, with different strip cross sections as wells as for strips with varying strip thickness and strip length or strip width. This enables for example processing in selected thickness ranges (such as for example a strip thickness of smaller than 1 mm, a strip thickness of 1 to 2 mm and a strip thickness of 2 to 4 mm).

When high-strength, hot strips or cold strips made of multiphase steel with varying sheet thicknesses are produced according to the invention in the continuous annealing method, stress-optimized components can advantageously be produced from this material by forming.

The produced material can be produced as cold strip and also as hot strip via a hot dip galvanizing line or a pure continuous annealing line in the skin passed or non skin passed state and also in the heat treated state (intermediate annealing).

At the same time it is possible to adjust the microstructure proportions by targeted variation of the process parameters so that steels of different strength classes, such as HDT580X, HCT600X, and HCT780X for example according to EN 10346 can be produced.

The steel strips produced with the alloy composition according to the invention are characterized in the manufacturing of a dual phase steel by a process window which is significantly wider compared to the standard regarding temperature and throughput speed in the inter-critical annealing between $A_{c1}$ and $A_{c3}$ or in an austenizing annealing above $A_{c3}$ with final controlled cooling or an annealing below the start of the dual-phase region (for example $A_{c1}$—about 20° C.).

Annealing temperatures of 700° C. to 950° C. have proven advantageous. Depending on the overall process there are different approaches for realizing the heat treatment.

In the continuous annealing system without subsequent hot dip coating, the strip is cooled starting from the annealing temperature to an intermediate temperature of about 200 to 250° C. with a cooling rate of about 15 to 100° C./s. Optimally, cooling to a previous intermediate temperature of 300 to 500° C. can occur beforehand with a cooling rate of 15 to 100° C./s. Finally cooling to room temperature occurs with a cooling rate of about 2 to 30° C.

In a heat treatment within the framework of a hot dip coating two possible temperature profiles exist. The cooling as described above is halted prior to entry into the dip bath and is only continued after emergence from the bath until reaching the intermediate temperature of about 200 to 250° C. Depending on the dip bath temperature, a holding temperature of about 420 to 470° C. results in this case. The cooling to room temperature occurs again with a cooling rate of 2 to 30° C./s.

The second variant of the temperature profile in the hot dip coating includes holding the temperature for about 1 to 20 s at the intermediate temperature of 200 to 250° C. and subsequent reheating to the temperature of 420 to 470° C. required for the hot dip coating. After the hot dip coating the strip is cooled again to 200 to 250° C. The cooling to room temperature occurs again with a cooling rate of 2 to 30° C./s.

Beside manganese, chromium and silicone, carbon is responsible for the transformation of austenite to martensite in classical dual-phase steels.

Only the combination according to the invention of the added elements carbon, silicone, manganese and chromium as well as niobium ensures on one hand the demanded mechanical properties of minimal tensile strength of 580 MPa and yield strength ratios of below 67% at simultaneous significantly widened process window in the continuous annealing.

The basis for achieving the wide process window is the micro-alloying according to the invention of exclusively with niobium, while taking into account the above mentioned classical composition of carbon/silicone/manganese/chromium with a manganese content which is stepped and defined according to the strip thickness.

Because the speed in the continuous annealing system is reduced with increasing cross section or strip thickness at same width, i.e., the time available for transformation increases, manganese has to take over this task in order to establish similar microstructure proportions over the selected thickness range (for example 0.5 to 4.0 mm) and to shift the phase transformations correspondingly, as schematically shown in FIG. 6 in the variants 1, 2 and 3.

Characteristic for the material is also that increasing weight percents of added manganese causes shifting of the ferrite region toward longer times and lower temperatures during cooling.

The proportions of ferrite are hereby reduced to a lesser or stronger degree by increased proportions of bainite depending on the process parameters.

Tests have shown that only the addition of the micro-alloy element niobium at contents of 0.005 to 0.025% is sufficient to achieve a wide process window and the typically required tensile strengths of at least 580 MPa for hot strip and at least 600 MPa for cold re-rolled hot strip and cold strip.

Only the controlled adding of manganese in the stated contents, as control parameter for compensating the influence of the cross section, enables uniform mechanical characteristic values and microstructure compositions at different strip thicknesses.

The micro-alloying of niobium enables the above described process robustness. By varying manganese, the influence of the cross section is compensated in the time-temperature transformation behavior.

By setting a low carbon content of ≤0.105% the carbon equivalent can be reduced which improves the weldability and excessive hardening is avoided. In addition the service life of the electrode in the resistance spot welding can be significantly increased.

In the following the effect of the elements in the alloy according to the invention is described in more detail. The multiphase steels typically have a chemical composition in which alloy components are combined with and without micro-alloying elements. Accompanying elements are unavoidable and are taken into account regarding their effect when necessary.

Accompanying elements are elements, which are already present in the iron ore or enter the steel due to manufacturing. Due to their predominantly negative effect they are usually undesired. It is sought to remove them to a tolerable content or to convert them into less deleterious forms.

Hydrogen (H) is the only element which can diffuse through the iron lattice without generating lattice tensions. As a result hydrogen is relatively mobile in the iron lattice and can be taken up relatively easily during manufacturing. Hydrogen can thereby only be taken up into the iron lattice in atomic (ionic) form.

Hydrogen has a strong embrittling effect and diffuses preferably to energetically favorable sites (defects, grain boundaries etc). The defects act as hydrogen traps and can significantly increase the retention time of the hydrogen in the material.

The recombination to molecular hydrogen can lead to cold cracks. This behavior occurs in the hydrogen embrittlement or in hydrogen-induced stress corrosion. Hydrogen is also often named as the cause for the so-called delayed fracture, which occurs without external tensions.

Therefore the hydrogen content in the steel should be as low as possible.

Oxygen (O): in the molten state, steel has a relatively great capacity for absorbing gases, however, at room temperature oxygen is only soluble in very low amounts. Analogous to hydrogen, oxygen can only diffuse into the material in atomic form. Due to the strongly embrittling effect and the negative effect on the ageing resistance, oxygen content is sought to be reduced during production as much as possible.

For reducing the oxygen, on one hand production methods such as a vacuum treatment, and on the other hand analytical approaches exist. By adding certain alloy elements oxygen can be converted into harmless states. Thus binding of oxygen via manganese, silicone and/or aluminum is common. However, the oxide produced thereby can cause negative properties in the material in the form of defects. On the other hand a fine precipitation of aluminum oxides can lead to a grain refinement.

For the above stated reasons the oxygen content in the steel should be as low as possible.

Nitrogen (N): is also an accompanying element in steel production. Steels with free nitrogen are prone to a strong ageing effect. Nitrogen already diffuses at low temperatures at dislocations and blocks the same. As a result it causes a strength increase associated with a fast loss of tenacity. Nitrogen can be bound in the form of nitrides by adding aluminum or titanium.

For the foregoing reasons the nitrogen content is limited to ≤0.0100%, ≤0.0090% or optimally to ≤0.0080% or to unavoidable amounts during steel production.

Sulfur (S): like phosphorous is bound as trace element in the iron ore. It is undesired in the steel (exception automate steels) because of its strong tendency for segregation and embrittling effect. It is therefore sought to achieve as low amounts of sulfur as possible in the metal (for example by a deep vacuum treatment). Further the present sulfur is converted into the relatively harmless compound manganese sulfide (MnS).

The manganese sulfides are often rolled out band-like during rolling and function as germination sites for the transformation. Especially in the case of diffusion controlled transformation this leads to a microstructure that is configured band-like and can lead to decreased mechanical properties in the case of strongly pronounced banding (for example pronounced martensite bands instead of distributed martensite islands, anisotropic material behavior, reduced elongation at brake).

For the foregoing reasons the sulfur content is limited to ≤0.0050% or to unavoidable amounts during steel production.

Phosphorous (P) is a trace element from the iron ore and is solubilized in the iron lattice as substitution atom. As a result of the solid solution strengthening phosphorous increases the strength and improves the hardenability.

However, it is usually sought to lower the phosphorous content as far as possible because among other things due to its slow diffusion speed it has a strong tendency to segregation and strongly lowers the tenacity. Deposition of phosphorus at the grain boundaries can lead to grain boundary cracks. In addition phosphorous increases the transition temperature from tenacious to brittle behavior by up to 300° C. During hot rolling, surface-proximate phosphorous oxides can lead to separation at the grain boundaries.

However, due to the low costs and the high strength increase, phosphorous is used in some steels in low amounts (<0.1%) as micro-alloying element. For example in high strength steels (interstitial free) or also in some alloying concepts for dual-phase steels.

For the aforementioned reasons phosphorous is limited to s 0.020% or to unavoidable amounts during steel production.

Alloying elements are usually added to the steel in order to influence properties in a targeted manner. An alloying element can influence different properties in different steels. The effect generally depends strongly on the amount and the solubility state in the material.

The interrelations can thus be very diverse and complex. In the following the effect of the alloying elements is described in more detail.

Carbon (C): counts as the most important alloy element in the steel. As a result of its targeted introduction to up to 2.06% iron is caused to become steel in the first place. Oftentimes the carbon content is drastically lowered during steel production. In dual-phase steels for a continuous hot dip coating its content is maximally 0.23%, a minimal value is not given.

Due to its relatively small atomic radius carbon is dissolved interstitially in the iron lattice. The solubility in the α-iron is maximally 0.02% and in the γ-iron maximally 2.06%. In solubilized form carbon increases the hardenability of steel significantly.

As a result of the different solubility, pronounced diffusion processes are necessary in the phase transformation, which can lead to very different kinetic conditions. In addition carbon increases the thermodynamic stability of the austenite, which becomes apparent in the phase diagram as a widening of the austenite region toward lower temperatures. With increasing force-solubilized carbon content in the martensite the lattice distortions increase and associated with this the strength of the non-diffusively generated phase.

In addition carbon is required for the formation of carbides. A representative is cementite ($Fe_3C$), which is present in almost every steel. However, significantly harder special carbides can form with other metals such as chromium, titanium, niobium and vanadium. Not only the type but also the distribution and size of the precipitations is of deciding importance for the resulting strength increase. In order to ensure a sufficient strength on one hand and a good weldability on the other hand, the minimal C-content is set to 0.075% and the maximal C-content to 0.105%.

Silicone (Si): binds oxygen during casting and thus lowers segregation and contaminations in the steel. In addition as a result of solid solution strengthening silicone increases the strength and the yield strength ratio of the ferrite at only slightly lowered elongation at break. A further important effect is that silicone shifts the formation of ferrite toward shorter times and thus enables the generation of sufficient amounts of ferrite prior to the quenching. As a result of the ferrite formation the austenite is enriched with carbon and is stabilized. At higher contents silicone stabilizes the austenite in the lower temperature range especially in the region of the bainite formation by preventing of carbide formation.

During the hot rolling a strongly adhering scale can form at high silicone contents, which can negatively affect the further processing.

In the continuous galvanizing silicone can diffuse during the annealing to the surface and by itself or together with manganese form film-like oxides. These oxides adversely affect the galvanization by impairing the galvanization reaction (solubilization of iron and formation of inhibition layer) during dipping of the steel strip into the zinc melt. This manifests itself in a poor zinc adhesion and un galvanized regions. By suitably operating the furnace with adjusted humidity in the annealing gas and/or by a low Si/Mn ratio and/or by using moderate amounts of silicone however, a good galvanization of the steel strip and a good zinc adhesion can be ensured.

For the aforementioned reasons the minimal Si-content is set to 0.200% and the maximal silicone-content to 0.300%.

Manganese (Mn) is added to almost every steel for de sulfurization in order to convert the deleterious sulfur into manganese sulfides. In addition as a result of solid solution strengthening, manganese increases the strength of the ferrite and shifts the α/γ transformation toward lower temperatures.

A main reason for adding manganese in dual-phase steel is the significant improvement of the hardness penetration. Due to the diffusion impairment the perlite and bainite transformation is shifted toward longer times and the martensite start temperature is lowered.

Like silicone, manganese tends to form oxides on the steel surface during the annealing treatment. Depending on the annealing parameters and the content of other alloy elements (in particular Si and Al), manganese oxides (for example MnO) and/or Mn mixed oxides (for example $Mn_2SiO_4$) can occur. However, manganese is less critical at a low Si/Mn or Al/Mn ratio because rather globular oxides instead of oxide films form. Nevertheless high manganese contents may negatively influence the zinc layer and the zinc hafting.

The Mn-content is therefore set to 1.000 to 2.000% depending on the cross section (strip thickness at same strip width). For a thickness range of 0.5-1.0 mm a manganese content of 1.00-1.50 weight % has proven advantageous, for the range 1.00-2.00 mm 1.25-1.75 weight % and for the range 2.0-4.0 mm a manganese content of 1.50-2.00 weight %.

Chromium (Cr): in dual-phase steels the addition of chromium mainly improves the hardness penetration. In the solubilized form chromium shifts the perlite and bainite transformation toward longer times and thereby at the same time lowers the martensite start temperature.

A further important effect is that chromium significantly increases the tempering resistance so that almost no strength losses occur in the zinc dip bath.

In addition chromium is a carbide former. When chromium is present in the carbide form the austenizing temperature has to be selected high enough prior to the hardening in order to solubilize the chromium carbides. Otherwise the increased number of nuclei may lead to an impairment of the hardness penetration.

Chromium also tends to form oxides on the steel surface during the annealing treatment, which may negatively affect the galvanization quality.

The Cr content is therefore set to values of 0.280 to 0.480%.

Molybdenum (Mo): similar to chromium, molybdenum is added for improving the hardenability. The perlite and baininte transformation is shifted toward longer times and the martensite start temperature is lowered.

Molybdenum also significantly increases the tempering resistance so that no strength losses are to be expected in the zinc bath and causes an increase in strength of the ferrite as a result of solid solution strengthening.

For reasons of cost Mo is therefore not added. The content of molybdenum is limited to unavoidable steel accompanying amounts.

Copper (Cu): the addition of copper can increase the tensile strength and the hardness penetration. In connection with nickel, chromium and phosphorous copper can form a protective oxide layer on the surface, which significantly reduces the corrosion rate.

In connection with oxygen copper can form deleterious oxides at the grain boundaries, which can have negative consequences in particular for hot forming processes. The copper content is therefore limited to amounts that are unavoidable during steel production.

The contents of other alloy elements such as nickel (Ni) or tin (Sn) are limited to amounts that are unavoidable during the steel production.

Micro-alloying elements are usually only added in very low amounts (<0.1%). In contrast to the alloying elements they are effective mainly through forming precipitations however they can also influence the properties in the solubilized state. In spite of the low added amounts, the micro-alloying elements strongly influence the production conditions such as processing and final properties.

Commonly used micro-alloying elements are carbide and nitride formers that are soluble in the iron lattice. Formation of carbonitrides is also possible due to the complete solubility of nitrides and carbides in each other. The tendency to form oxides and sulfides is usually most pronounced in the micro-alloying elements however it is usually prevented in a targeted manner due to other alloying elements.

This property can be used advantageously in that the generally deleterious elements sulfur and oxygen can be bound. However, the binding can also have negative consequences when it results in the fact that sufficient amounts of micro alloying elements are no longer available for the formation of carbides.

Typical micro-alloying elements are aluminum, vanadium, titanium and boron. These elements can be solubilized in the iron lattice and together with carbon and nitrogen form carbides and nitrides.

Aluminum (Al) is usually added to the steel in order to bind oxygen and nitrogen solubilized in the iron. In this way, oxygen is converted into aluminum oxides and aluminum nitrides. These precipitations can cause a grain refinement via increasing the nucleation sites and thus increase the tenacity and strength values.

Aluminum nitride is not precipitated when titanium is present in sufficient amounts. Titanium nitrides have a lower formation enthalpy and are formed at higher temperatures.

In the solubilized state aluminum, like silicone, shifts the ferrite formation toward shorter times and thus enables the formation of sufficient amounts of ferrite in the dual-phase steel. In addition it suppresses the carbide formation and leads thus to a delayed transformation of the austenite. For this reason Al is also used as alloy element in residual austenite steels in order to substitute for a portion of the silicone by aluminum. The reason for this approach is that Al is less critical for the galvanization reaction than silicone.

The Al-content is therefore limited to 0.01 to maximally 0.060%.

Niobium (Nb): beside the above described effect on a widening of the process window as a result of a delayed phase transformation during the continuous annealing, niobium also causes a strong grain refinement because it is most effective among all micro-alloying elements in delaying the recrystallization and in addition inhibits the austenite grain growth.

The strength increasing effect is qualitatively higher than that of titanium, manifested by the increased grain refining effect and the greater number of strength increasing particles (binding of the titanium to TiN at high temperatures). Niobium carbides form at temperatures below 1200° C. In the case of binding of nitrogen with titanium, niobium can increase its strength increasing effect by forming small and effective carbides in the lower temperature range (smaller carbide sizes).

A further effect of niobium is the delay of the $\alpha/\gamma$-transformation and the lowering of the martensite start temperature in the solubilized state. On one hand this occurs by solute drag effect and on the other hand by grain refinement. The latter causes a strength increase of the microstructure and with this also a higher resistance against the volume increase during martensite formation.

In principle the addition of niobium is limited by its solubility limit. The latter limits the amount of precipitations, however, causes in particular the formation of early precipitations with relatively large particles when exceeded.

The precipitation hardening can thus in particular be effective in steels with low C-contents (greater oversaturation possible) and in hot-forming processes (deformation induced precipitation).

The niobium content is therefore limited to values between 0.005 and 0.025%, wherein the content is advantageously limited to ≥0.005 to ≤0.020%.

Titanium (Ti): because in the present alloy concept addition of titanium is not required, the content of titanium is limited to unavoidable steel accompanying amounts.

Vanadium (V): because in the present alloy concept addition of vanadium is not required, the content of vanadium is limited to unavoidable steel accompanying amounts.

Boron (B): because in the present alloy concept addition of boron is not required, the content of boron is limited to unavoidable steel accompanying amounts.

Tests conducted with the steel according to the invention have shown that with the present alloy concept a dual-phase steel with a minimal tensile strength of 580 MPa can be achieved by annealing of a hot strip above $A_{c3}$.

With an inter-critical annealing between $A_{c1}$ and $A_{c3}$ or an austenizing annealing above $A_{c3}$ with final controlled cooling a multiphase steel strip with dual phase microstructure was produced in the thickness range of 0.50 to 4.00 mm which was characterized by a great tolerance with regard to process fluctuations.

With this, a significantly widened process window is established for the alloy composition according to the invention compared to known alloy concepts.

For the steel according to the invention, the annealing temperatures for the dual-phase microstructure to be achieved are between about 700 and 950° C.; depending on the temperature range this achieves a re-crystallized (single-phase region), partially austenitic (dual-phase region) microstructure or a fully austenitic microstructure (austenitic region) is achieved.

The tests show that the established microstructure proportions after an inter-critical annealing between $A_{c1}$ and $A_{c3}$ or the austenizing annealing above $A_{c3}$ with subsequent controlled cooling are maintained also after a further process step (hot dip coating at temperatures between 420 to 470° C. for example in the case of Z (zinc) and ZM (zinc-magnesium).

The hot dip coated material can be manufactured as hot strip as well as cold re-rolled hot strip or cold strip in the skin passed rolled (cold re-rolled) or non skin pass rolled state and/or stretch leveled or not stretch leveled state.

Steel strips, in the present case as hot strips, cold re-rolled hot strip or cold strip made from the alloy composition according to the invention, are in addition characterized by a high resistance against edge proximate crack formation during the further processing.

The small differences in the characteristic values of the steel strip, longitudinally and transversely to its rolling direction are advantageous in the subsequent material insertion, which as a result may be transversely, longitudinally a diagonally to the rolling direction.

In order to ensure the cold rollability of a hot strip produced from the steel according to the invention, the hot strip is according to the invention produced with final rolling temperatures in the austenitic range above $A_{c3}$ and coiling temperature above the recrystallization temperature.

BRIEF DESCRIPTION OF THE DRAWING

Further features, advantages and details of the invention will become apparent from the following description of exemplary embodiments shown in the drawing.

It is shown in:

FIG. 3: examples for analytical differences of the steel according to the invention relative to the standard grade, which exemplifies the state of the art FIG. 4*a*: Examples for mechanical characteristic values (transversely and longitudinally to the rolling direction) of the steel according to the invention compared to the standard grade which exemplifies the state of the art in the strength class HCT600X.

FIG. 4*b*: regression calculations for mechanical characteristic values transversely to the rolling direction of the steel according to the invention variant 1, 2 and 3

FIG. 4*c*: example for mechanical characteristics (transversely to the rolling direction) of the steel according to the invention (variant 1) compared to the standard grade which exemplifies the state of the art in the strength class HCT780X for sheet thickness <1 mm.

FIG. 4*d*: example for mechanical characteristic values (transversely to the rolling direction) of the steel according to the invention variant 1 in the strength class HDT580X for strip thickness 2.50 mm.

FIG. 8: overview over the strength classes that can be set with the alloy concept according to the invention (exemplary for variant 13)

DETAILED DESCRIPTION OF PREFERRED EMBODIMENTS

Figure 1:
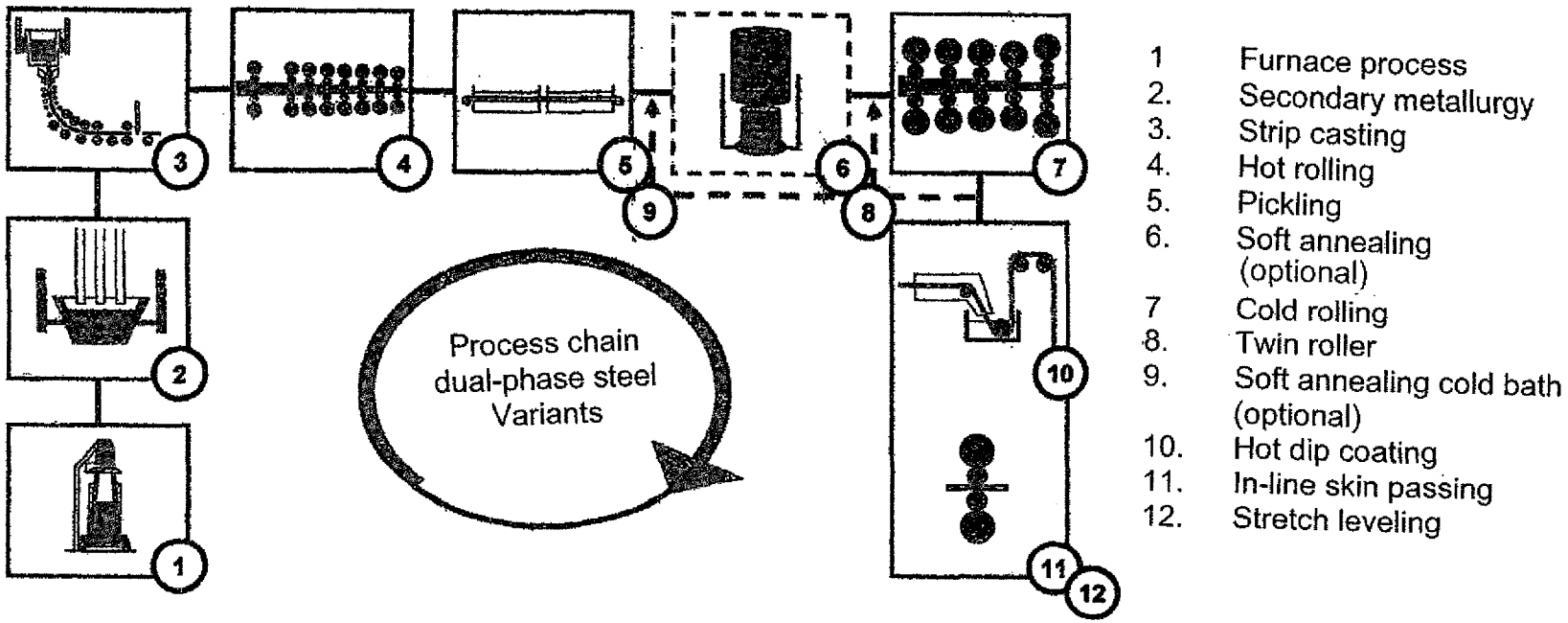
FIG. 1: schematically the process chain for the production of the steel according to the invention

FIG. 1 shows schematically the process chain for producing the steel according to the invention. Shown are the different process routes with regard to the invention. Up to position 5 (pickling) the process route is the same for all steels according to the invention, thereafter divergent process routes follow depending on the desired results. For example the pickled hot strip can be galvanized or cold rolled and galvanized. Or it can be soft annealed, cold rolled and galvanized.

Figure 2:
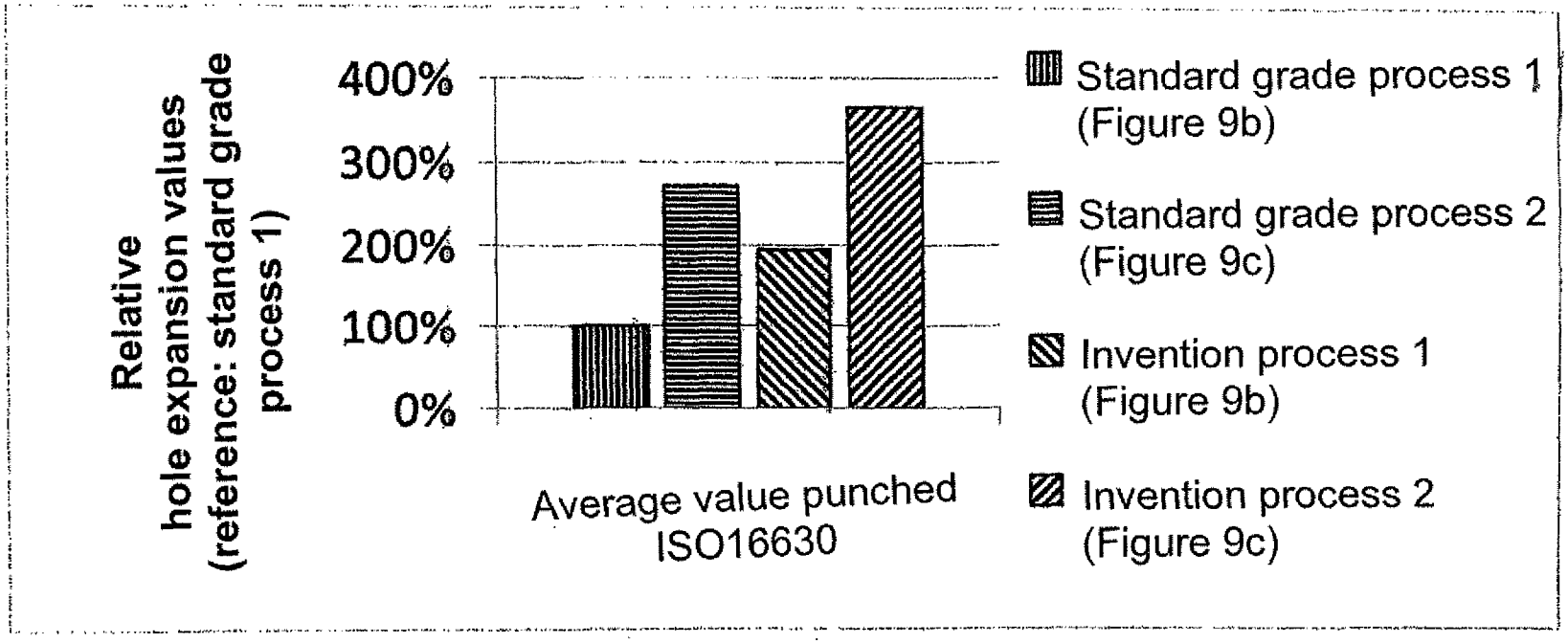
FIG. 2: results of a hole expansion test (sheet thickness 2.50 mm) exemplary for the steel according to the invention (variant 1) relative to the state of the art
Figure 9A:
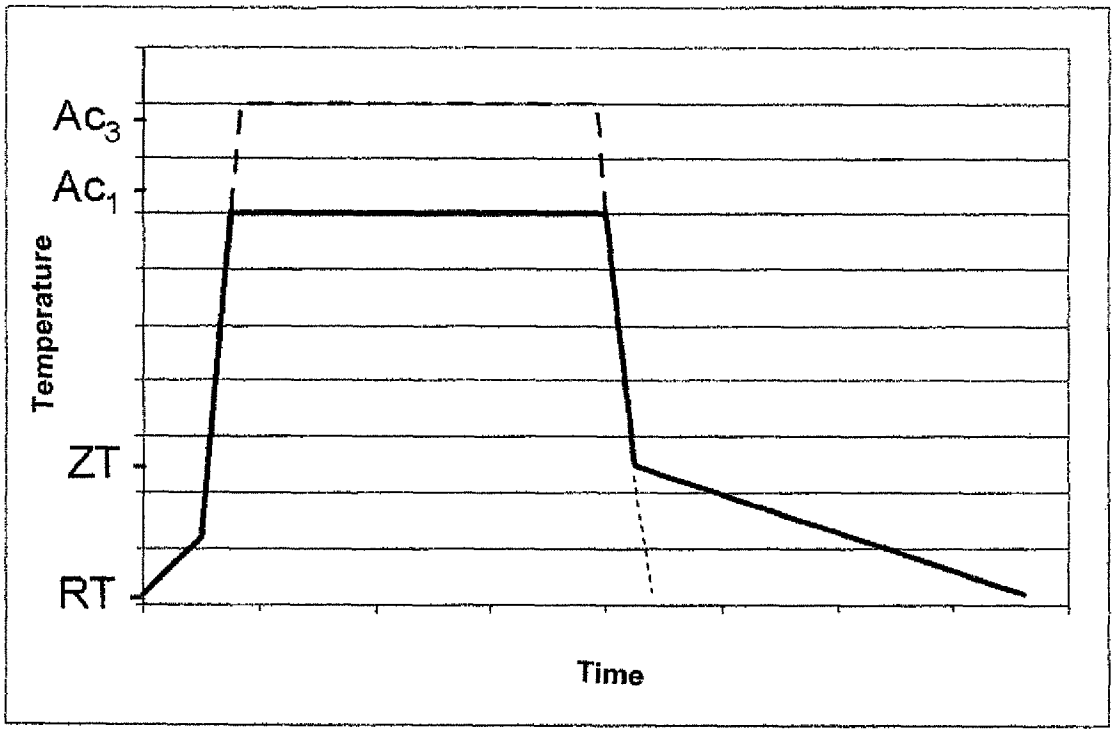
FIG. 9*a*: temperature-time curve (schematic, method 1)
Figure 9B:
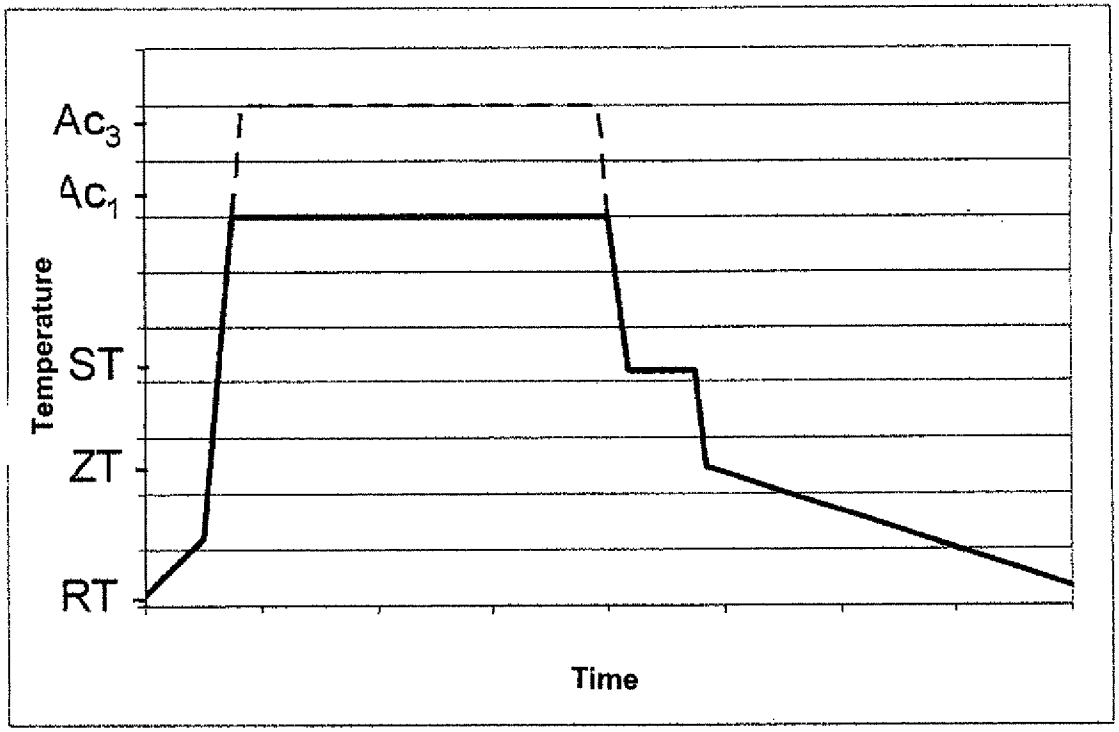
FIG. 9*b*: temperature-time curve (schematic method 2)
Figure 9C:
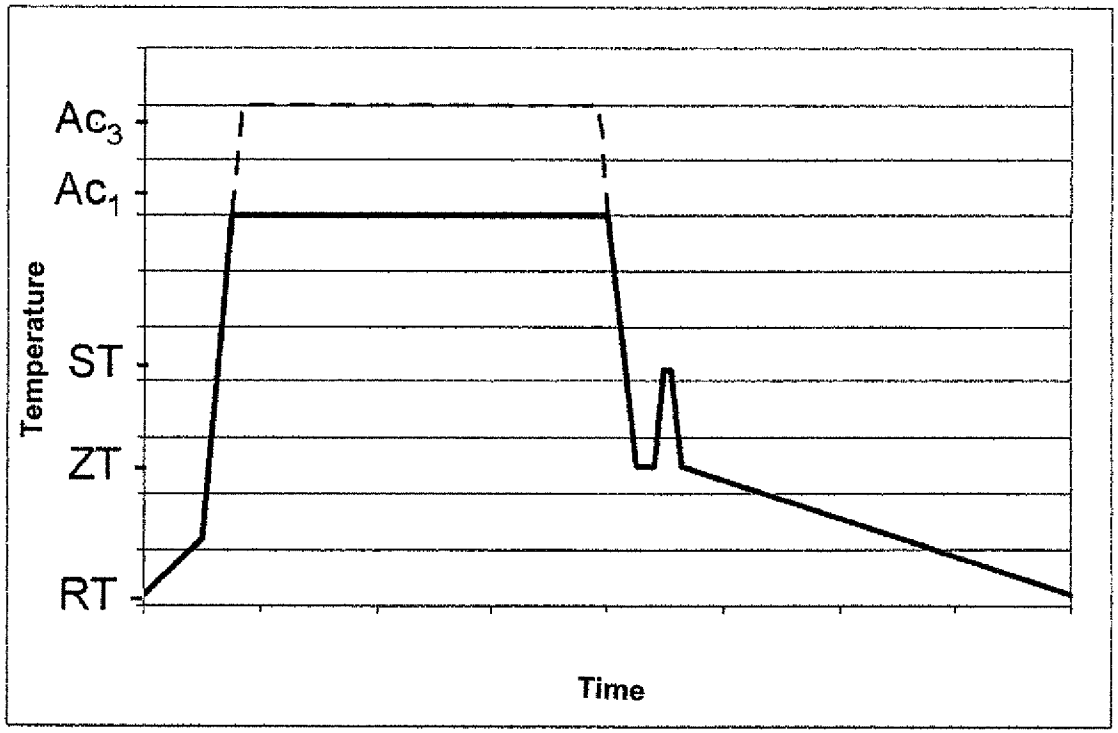
FIG. 9*c*: temperature-time curve (schematic, method 3)

FIG. 2 shows results of a hole expansion test (relative values compared to each other). Shown are the results of the hole expansion test for a steel according to the invention (variant 1, see FIG. 3) compared to the standard grades, as reference serves standard grade process 1. All materials have a sheet thickness of 2.50 mm, the results apply to the test according to ISO 16630. It can be seen that the steel according to the invention achieve better expansion values in the case of punched holes than the standard grades with same processing. Process 1 corresponds hereby to an annealing for example to a hot dip galvanization with combined directly fired furnace and radiant tube furnace, as described in FIG. 9*b*. The process 2 corresponds for example to a process sequence in a continuous annealing system, as described in FIG. 9*c*. In addition in this case a reheating of the steel by means of an induction furnace can optionally be achieved immediately prior to the galvanizing bath. As a result of the different temperature courses according to the invention within the mentioned range, different characteristic values result or also a different hole expansion results which are both significantly improved compared to the standard grades. A principal difference are thus the temperature-time parameters in the heat treatment and the downstream cooling.

FIG. 3: shows the relevant alloy elements of the steel according to the invention compared to standard grade, which exemplifies the state of the art. In the comparison steel (standard grade) which corresponds to the state of the art, the main difference is in the carbon content, which lies in the hyper-peritectic range, but also in the elements silicone, manganese and chromium. In addition the standard grade is micro-alloyed with phosphorous. The steels according to the invention are micro alloyed with niobium and have a significantly increased manganese content.

FIG. 4*a*: shows the mechanical characteristic values transversely and longitudinally to the rolling direction of the steel according to the invention for example in its variant 1, 2 and 3 compared to the standard grade which exemplifies the state of the art. All characteristic values, which were achieved by annealing in the dual phase region, correspond to the normative guidelines of a HCT600X.

FIG. 4*b*: shows the mechanical characteristic values transversely to the rolling direction of the steel according to the invention exemplary in its variants 1, 2 and 3 which was determined via a regression calculation. Shown are the mechanical characteristic values depending on the manganese content variation depending on the strip thickness (invention variants 1, 2 and 3). All characteristic values correspond to the normative guidelines. The yield ultimate ratio is significantly below 67% for all variants.

FIG. 4*d*: shows the mechanical characteristic values transversely to the rolling direction and the chemical composition of the steel according to the invention (variant 1) in case of a material thickness or 2.50 mm and an annealing above Ac3. All characteristic values correspond to the normative guidelines of HDT580X.

Figure 5:
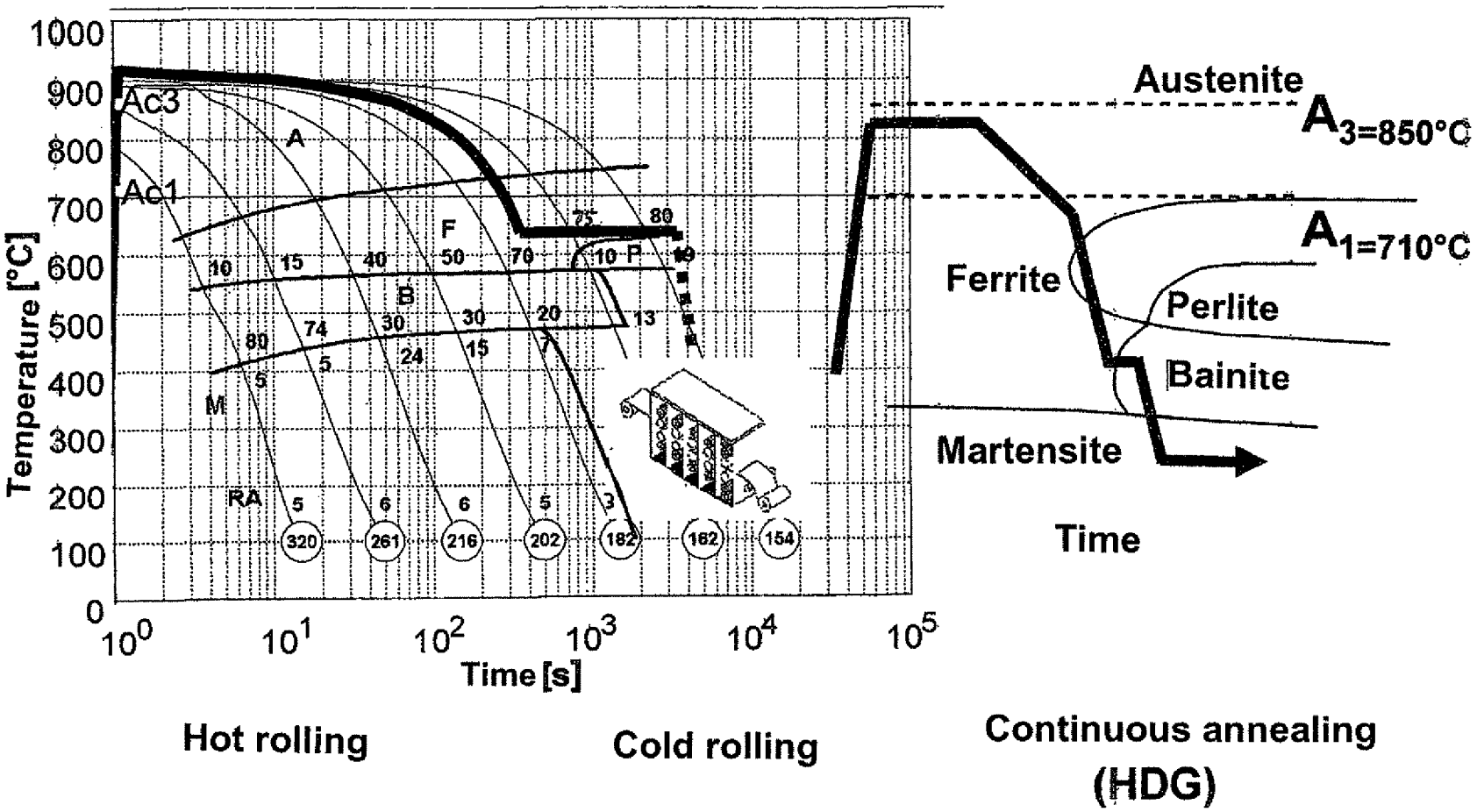
FIG. 5: schematically the time temperature course of the process steps hot rolling and continuous annealing, exemplary for variant 1

FIG. 5: schematically shows the time temperature course of the process steps hot rolling and continuous annealing of strips made of the alloy composition according to the invention. Shown is the time and temperature dependent transformation for the hot rolling process as well as for a heat treatment after the cold rolling, exemplary for variant 1.

Figure 6:
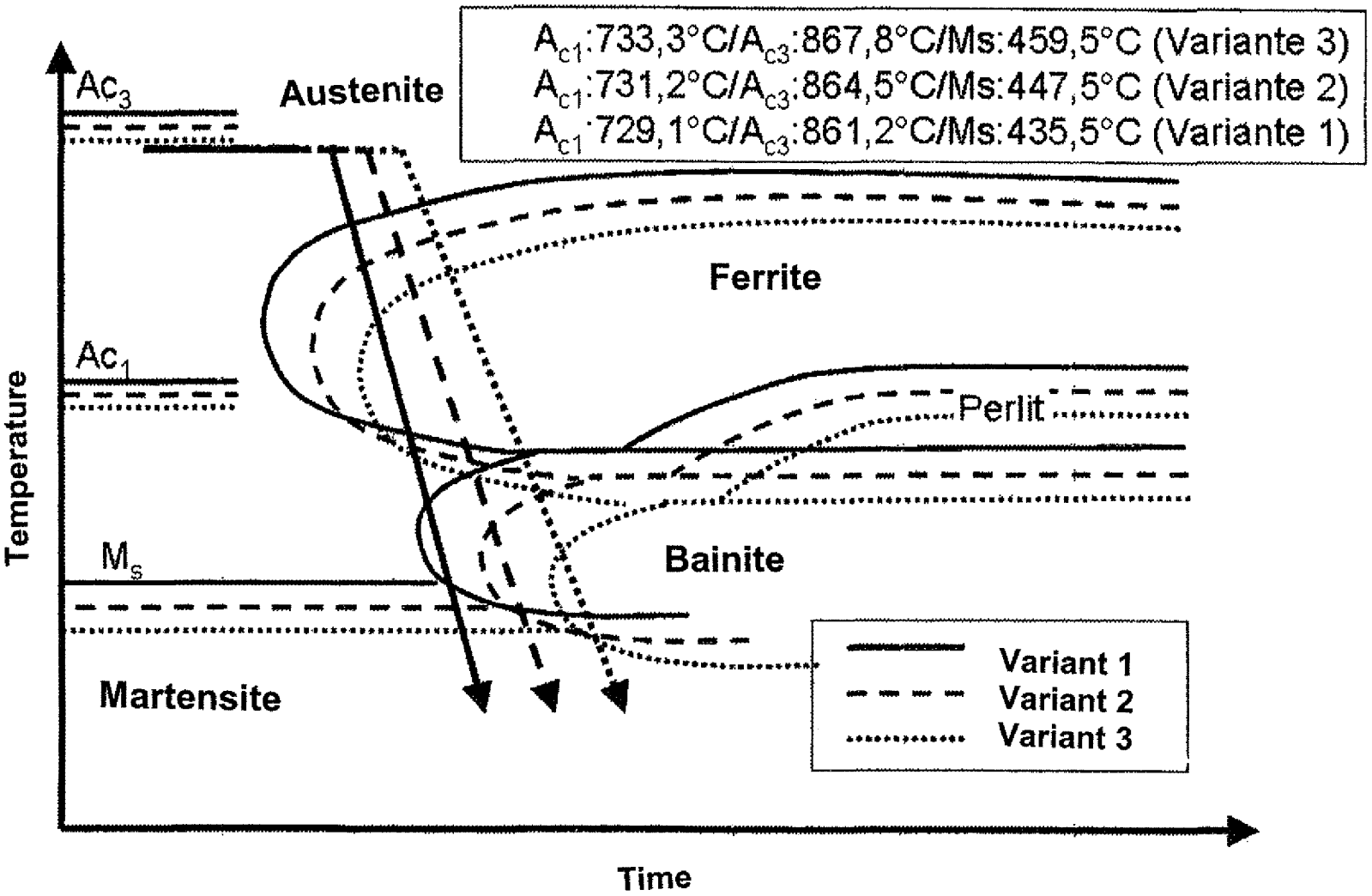
FIG. 6: schematic ZTU diagram for the steel according to the invention with the variants 1, 2 and 23

FIG. 6: shows a schematic ZTU diagram for the steel according to the invention, differentiated according to variant 1, 2 and 3. Herein the determined ZTU diagram is shown with the corresponding chemical composition (variation of exclusively contents of manganese) and the Ac1 and Ac3 temperature. By adjusting corresponding temperature time course during the cooling s wide spectrum of microstructure compositions can be advantageously adjusted. Of particular interest is here also the shifting of the ferrite nose, perlite nose and bainite nose toward later times in the graded increase of manganese contents, this enables the potential to adjust similar microstructure proportions over the entire thickness spectrum in a system speed which depends on the strip thickness.

Figure 7:
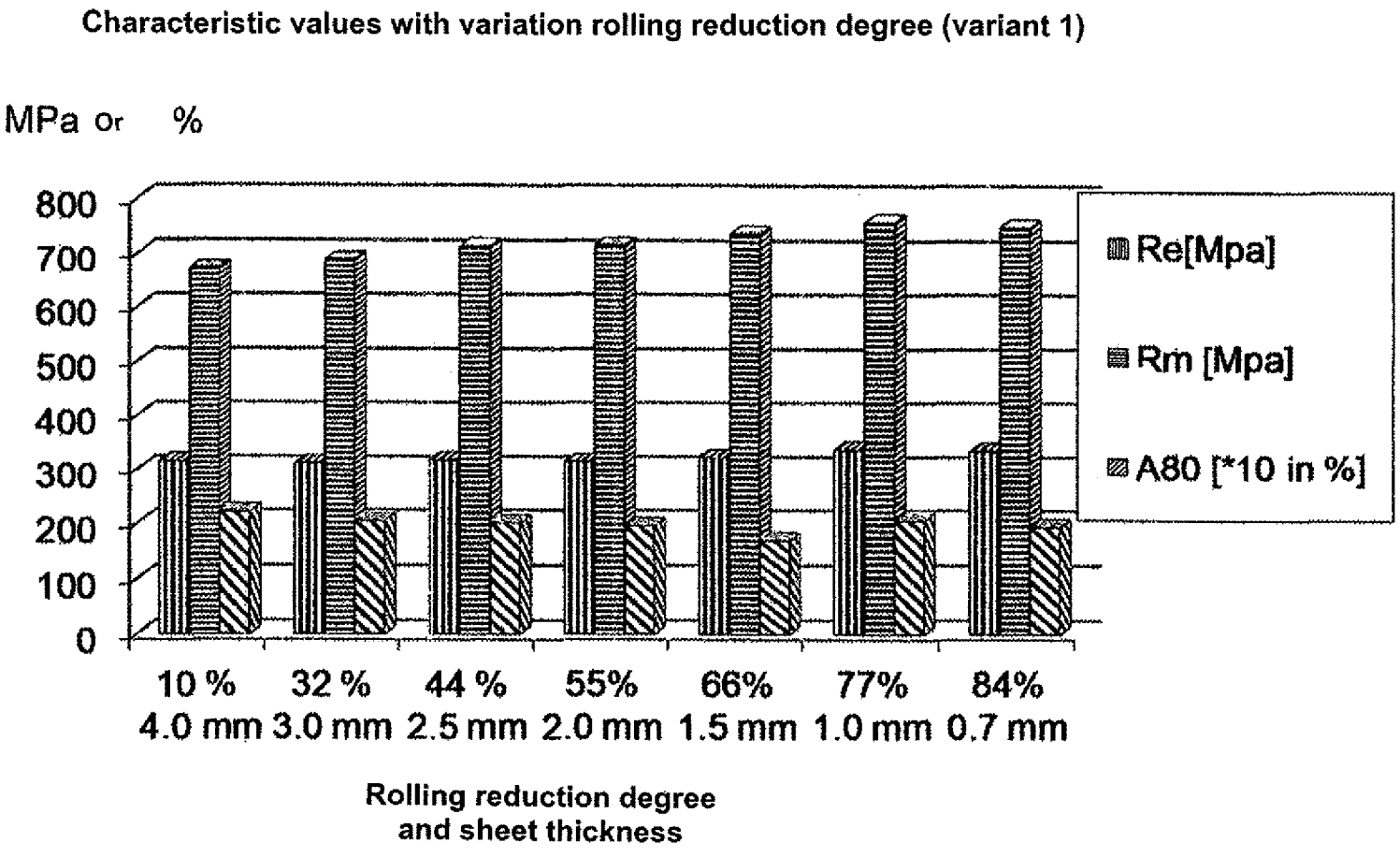
FIG. 7: mechanical characteristic values (longitudinally to the rolling direction) when varying the rolling degrees (?) (exemplary variant 1)

FIG. 7: shows the mechanical characteristic values longitudinally to the rolling direction with same parameters of continuously annealed strips when varying the rolling reduction degrees or different strip thickness when form example observing variant 1. Shown are the characteristic values tensile strength, yield strength and elongation at break in dependence on selected rolling reduction degrees. Only the tensile strength increases with increasing rolling reduction degrees. All values up to 30% rolling reduction degrees are in the range of the norm for HCT600X. Higher rolling reduction degrees (greater than 75%) lead to the steel grade shift toward HCT780X with minimal strengths of 780 MPa.

FIG. 8: shows an overview over the strength classes that can be adjusted with the alloy concept according to the invention (variant 1). The used alloy composition corresponds to the one shown in FIG. 3. Shown are the differently processed steel strips with their characteristic values longitudinally to the rolling direction and microstructure compositions. This illustrates the range of adjustable strength classes for hot and cold strips with the resulting microstructure proportions depending of the performed process steps and the adjusted process parameters.

FIG. 9 schematically show the temperature time courses in the annealing treatment and cooling with three different variants and in each case different austenizing conditions corresponding to the applied for claims to the method.

The method 1 (FIG. 9*a*) shows the annealing and cooling of produced cold or hot rolled steel strip in a continuous annealing system. First the strip is heated to a temperature in the range of about 700 950° C. the annealed steel strip ins subsequently cooled from the annealing temperature to an intermediate temperature of about 200 to 250° C. with a cooling rate between about 15 and 100° C./s, a second intermediate temperature (about 300 to 500° C.) is not shown in this schematic representation. Subsequently the steel strip is cooled at air until reaching room temperature with a cooling rate between about 2 and 30° C./s or the cooling with a cooling rate between about 15 and 100° C./s until reaching room temperature is maintained.

The method 2 (FIG. 9*b*) shows the process according to method 1, however the cooling is briefly interrupted for the purpose of a hot dip galvanizing when passing through the hot dip container and is continued with a cooling rate between about 15 and 100° C./s until reaching an intermediate temperature of about 200 to 250° C. subsequently the steel strip is cooled at air with a cooling rate between about 2 and 30° C./s until reaching room temperature.

The method 3 (FIG. 9*c*) also shows the process according to method 1 in a hot dip coating, however the cooling of the steel strip is interrupted by a brief brake (about 1 to 20 s) at an intermediate temperature in the range of about 200 to 250° C. and reheated to a temperature which is required for hot dip coating (about 420 to 470° C.). Subsequently the steel strip is cooled again until reaching an intermediate temperature of about 200 to 250° C. The final cooling of the steel strip to room temperature occurs at air with a cooling rate of about 2 and 30° C./s

The invention claimed is:

1. A method for producing a cold or hot rolled steep strip, said method comprising:

providing a high-strength multiphase steel with minimal tensile strengths of 580 MPa for a cold or hot rolled steel strip composed of the following elements in weight %:

C 0.075 to ≤0.105
Si 0.200 to ≤0.300
Mn 1.000 to ≤2.000
Cr 0.280 to ≤0.480
Al 0.010 to ≤0.060
P ≤0.020
Nb ≥0.005 to ≤0.025
N ≤0.0100
S ≤0.0050 remainder iron including usual steel accompanying elements not mentioned above, wherein boron is limited to unavoidable steel accompanying element amounts in the high-strength multiphase steel;

producing a cold rolled or hot rolled strip from the high-strength multiphase steel;

adjusting the Mn content of the high-strength multiphase steel as a function of a different thickness of the strip to obtain comparable material properties of the strip at different thicknesses of the strip, wherein the Mn-content is adjusted to ≥1.000 to ≤1.500% at strip thicknesses 0.50-1.00 mm, to ≥1.250 to ≤1.750% at strip thicknesses 1.00-2.00 mm and to ≥1.500 to ≤2.000% at strip thicknesses 2.00-4.00 mm;

heating the cold or hot rolled steel strip in a continuous annealing furnace to an annealing temperature in the range of about 700 to 950° C. to produce an annealed strip;

cooling the annealed strip from the annealing temperature to a first intermediate temperature of about 300 to 500° C. at a cooling rate between about 15 and 100° C./s; and cooling the strip to room temperature.

2. The method of claim 1, wherein the Nb content is ≥0.005 to ≤0.020%.

3. The method of claim 1, wherein the N content is ≤0.0090%.

4. The method of claim 1, wherein the N content is ≤0.0080%.

5. The method of claim 1, wherein for reaching a minimal tensile strength of 780 MPa the Mn content of the steel is 1.500 to 5 2.000 and the steel strip is heated in the heating step below the transformation point $A_{c1}$ but not below 700° C.

6. The method of claim 1, wherein for reaching a minimal tensile strength of 780 MPa the Mn content of the steel is 1.500 to 5 2.000, the steel strip has roll reduction degrees of greater than 75% and is heated in the heating step between $A_{c1}$ and $A_{c3}$.

7. The method of claim 1, further comprising producing in a system multiple of said strip, said multiple strips having different thicknesses and adjusting a throughput speed of the system as a function of the different thicknesses of the strips during heat treatment so as to adjust comparable microstructure states and mechanical characteristic values among the multiple strips.

8. The method of claim 1, further comprising skin passing the steel strip subsequent to the heating and cooling steps.

9. The method of claim 1, further comprising stretch leveling the steel strip subsequent to the heating and cooling steps.

10. The method of claim 1, having a dual-phase microstructure.

11. The method of claim 1, wherein the strip is cooled from the first intermediate temperature to a second intermediate temperature of about 200 to 250° C. with a cooling rate between about 15 and 100° C./s, and subsequently cooled on air with a cooling rate of about 2 to 30° C./s until reaching the room temperature.

12. The method of claim 11, further comprising hot dip coating the strip in a hot dip bath, wherein subsequent to the healing and subsequent cooling the cooling is hated prior to entering into the hot dip bath, and after the hot dip coating the cooling is continued with a cooling rate between about 15 and 100° C./s until reaching the second intermediate temperature of about 200 to 250° C., and subsequently the steel strip is cooled on air with a cooling rate between about 2 and 30° C./s until reaching the room temperature.

13. The method of claim 11, further comprising hot dip coating the steel strip in a hot dip bath, wherein after the heating and subsequent cooling to the second intermediate temperature of about 200 to 250° C. and prior to entering the hot dip bath the temperature is held for about 1 to 20 s and subsequently the steel strip is reheated to the temperature of about 420 to 470° C. and after the hot dip coating the steel strip is cooled until reaching the second intermediate temperature of about 200 to 250° C. with a cooling rate between about 15 and 100° C./s, and subsequently the steel strip is cooled on air with a cooling rate of about 2 and 30° C./s until reaching the room temperature.

14. The method of claim 1, wherein the strip is cooled by maintaining a cooling rate between about 15 to 100° C./s from the first intermediate temperature to the room temperature.

* * * * *